US008844072B2

(12) United States Patent
Bellows et al.

(10) Patent No.: US 8,844,072 B2
(45) Date of Patent: Sep. 30, 2014

(54) INFANT SUPPORTING APPARATUS

(71) Applicants: William B. Bellows, Wyomissing, PA (US); Jonathan M. Pacella, Coatesville, PA (US); Jonathan K. Mountz, Geigertown, PA (US); Jennifer E. Craig, Malvern, PA (US); Nathanael Saint, Morgantown, PA (US)

(72) Inventors: William B. Bellows, Wyomissing, PA (US); Jonathan M. Pacella, Coatesville, PA (US); Jonathan K. Mountz, Geigertown, PA (US); Jennifer E. Craig, Malvern, PA (US); Nathanael Saint, Morgantown, PA (US)

(73) Assignee: Wonderland Nurserygoods Company Limited, Hong Kong (HK)

( * ) Notice: Subject to any disclaimer, the term of this patent is extended or adjusted under 35 U.S.C. 154(b) by 0 days.

(21) Appl. No.: 13/909,153

(22) Filed: Jun. 4, 2013

(65) Prior Publication Data

US 2013/0318709 A1 Dec. 5, 2013

Related U.S. Application Data

(60) Provisional application No. 61/689,389, filed on Jun. 5, 2012.

(51) Int. Cl.

| | |
|---|---|
| ***A47D 9/00*** | (2006.01) |
| ***A47C 9/00*** | (2006.01) |
| ***A47D 9/02*** | (2006.01) |
| ***A47D 13/10*** | (2006.01) |

(52) U.S. Cl.

CPC . *A47D 9/02* (2013.01); *A47C 9/005* (2013.01); *A47D 13/102* (2013.01)

USPC ..... 5/101; 5/603; 5/102

(58) Field of Classification Search

CPC ..... A47D 15/008; A47D 5/006; A47D 13/02; A47D 9/00; A47D 9/005; A61G 2200/14

USPC ..... 5/603, 101–107, 114, 655

See application file for complete search history.

(56) References Cited

U.S. PATENT DOCUMENTS

| | | | | | |
|---|---|---|---|---|---|
| 341,238 | A | * | 5/1886 | Heinss | 5/106 |
| 1,463,571 | A | * | 7/1923 | Brame | 248/164 |
| 3,344,443 | A | * | 10/1967 | Bounell | 5/120 |
| 4,377,011 | A | * | 3/1983 | Kinberger | 5/102 |
| 4,996,732 | A | * | 3/1991 | Chang | 5/101 |
| 5,307,531 | A | * | 5/1994 | Kao | 5/108 |
| 5,496,094 | A | | 3/1996 | Schwartzkopf et al. | |

(Continued)

FOREIGN PATENT DOCUMENTS

| | | |
|---|---|---|
| GB | 738030 | 10/1955 |
| GB | 2214421 A | 9/1989 |
| GB | 2427152 A | 12/2006 |
| GB | 2447099 A | 9/2008 |

*Primary Examiner* — Robert G Santos
*Assistant Examiner* — Richard G Davis
(74) *Attorney, Agent, or Firm* — David I. Roche; Baker & McKenzie LLP

(57) ABSTRACT

An infant supporting apparatus includes a base frame, a support frame and a resting support. The base frame includes a first and a second leg frame portion pivotally connected with each other about a first pivot axis, wherein the first and second leg frame portions have foot portions. The support frame is assembled with the base frame, and includes a first and a second support frame portion pivotally connected with each other about a second pivot axis spaced apart from the first pivot axis, the first and second pivot axes being vertically aligned with each other. The resting support is suspended from the first and second support frames for receiving the placement of a child.

25 Claims, 16 Drawing Sheets

(56) References Cited

U.S. PATENT DOCUMENTS

| | | | | |
|---|---|---|---|---|
| 5,694,655 | A | 12/1997 | Shepler et al. | |
| 6,386,986 | B1 * | 5/2002 | Sonner et al. | 472/119 |
| 6,851,745 | B2 | 2/2005 | nee Wilkins et al. | |
| 8,142,297 | B2 * | 3/2012 | Zhang | 472/119 |
| 2007/0257534 | A1 | 11/2007 | Schulte et al. | |
| 2010/0163088 | A1 * | 7/2010 | Zeng | 135/88.02 |
| 2010/0255919 | A1 * | 10/2010 | Kelly et al. | 472/118 |
| 2011/0148155 | A1 | 6/2011 | Chapman et al. | |
| 2013/0012329 | A1 | 1/2013 | Burns et al. | |

* cited by examiner

126

170

INFANT SUPPORTING APPARATUS

CROSS-REFERENCE TO RELATED APPLICATION

This application claims priority to U.S. Provisional Patent Application No. 61/689,389 filed on Jun. 5, 2012, the entirety of which is incorporated herein by reference.

BACKGROUND

1. Field of the Invention

The present invention relates to infant support apparatuses, and more particularly to infant support apparatuses capable of rocking motions.

2. Description of the Related Art

It is well known that gentle and regular rocking motions can help to soothe young children. Accordingly, multiple types of devices have been developed to recreate an appropriate rocking motion that can soothe children, which include bouncing apparatuses, travel swings, gliders and rocking apparatuses. However, the existing devices may have some disadvantages. For example, baby cradles may not be easy to collapse for storage or transport. Other rocking supports may have a support structure where the child is placed that is held on support legs at a relatively high position, which may be detrimental to its stability.

Therefore, there is a need for an infant supporting apparatus that is capable of rocking motions, and can address at least the foregoing issues.

SUMMARY

The present application describes an infant supporting apparatus. The infant supporting apparatus includes a base frame, a support frame and a resting support. The base frame includes a first and a second leg frame portion pivotally connected with each other about a first pivot axis, wherein the first and second leg frame portions have foot portions. The support frame is assembled with the base frame, and includes a first and a second support frame portion pivotally connected with each other about a second pivot axis spaced apart from the first pivot axis, the first and second pivot axes being vertically aligned with each other. The resting support is suspended from the first and second support frames for receiving the placement of a child. In some configurations, the infant supporting apparatus is provided with additional functional features including a recline adjustment mechanism for the resting support, a stabilizing structure operable to keep the infant supporting apparatus stationary, and a detachable vibrating unit operable to impart vibration to the resting support.

DETAILED DESCRIPTION OF THE EMBODIMENTS

Figure 1:
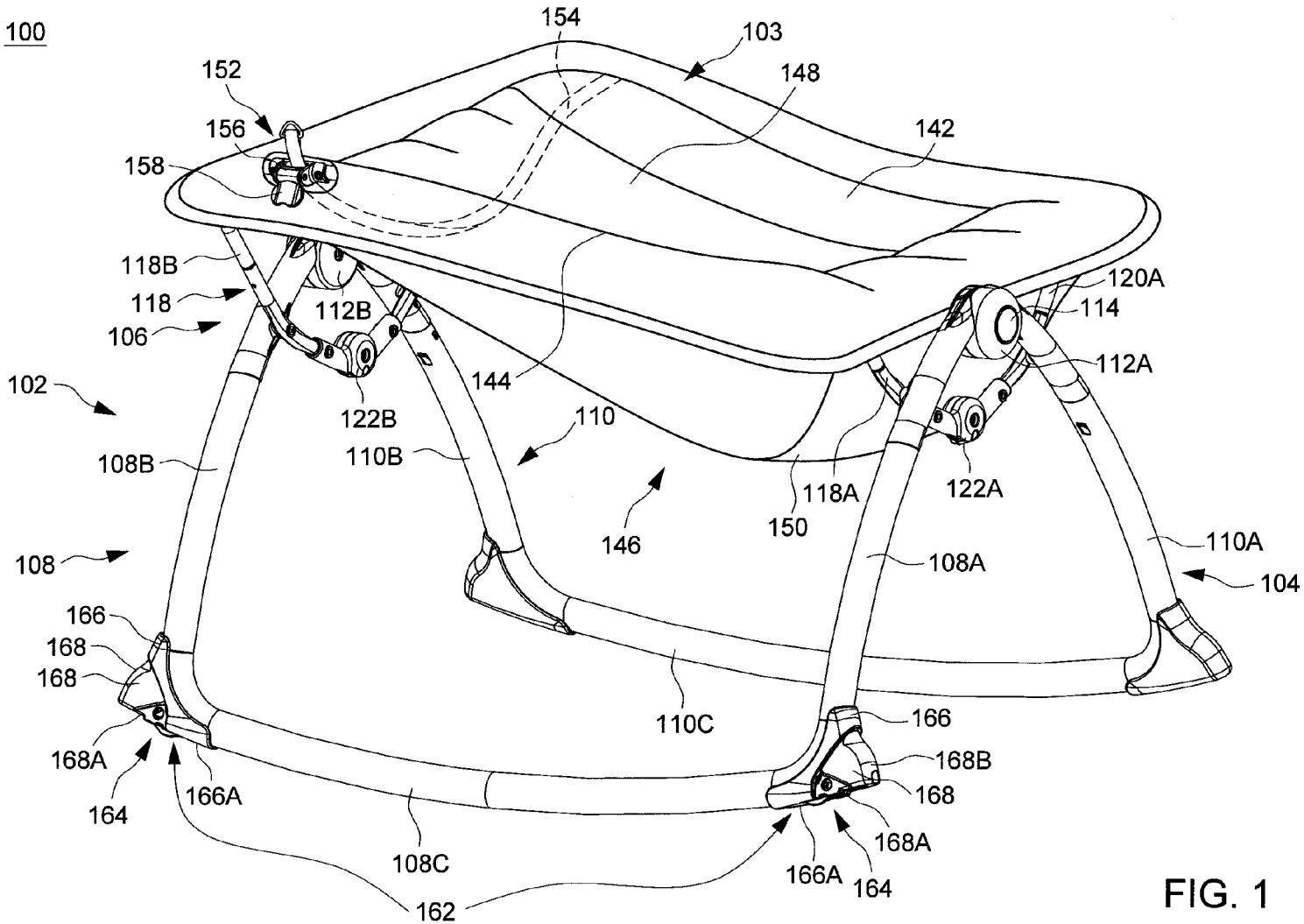
FIG. 1 is a schematic view illustrating on embodiment of an infant supporting apparatus.

FIG. 1 is a perspective view illustrating one embodiment of an infant supporting apparatus 100. The infant supporting apparatus 100 can include a frame structure 102, and a resting support 103 coupled with the frame structure 102. The frame structure 102 can include a base frame 104, and a support frame 106 connected with an upper portion of the base frame 104. The base frame 104 can rest on a ground surface. Moreover, a lower portion of the base frame 104 can have a curved shape that can rock on the ground surface. The resting support 103 can be suspended from the support frame 106 to receive the placement of a child thereon.

Figure 2:
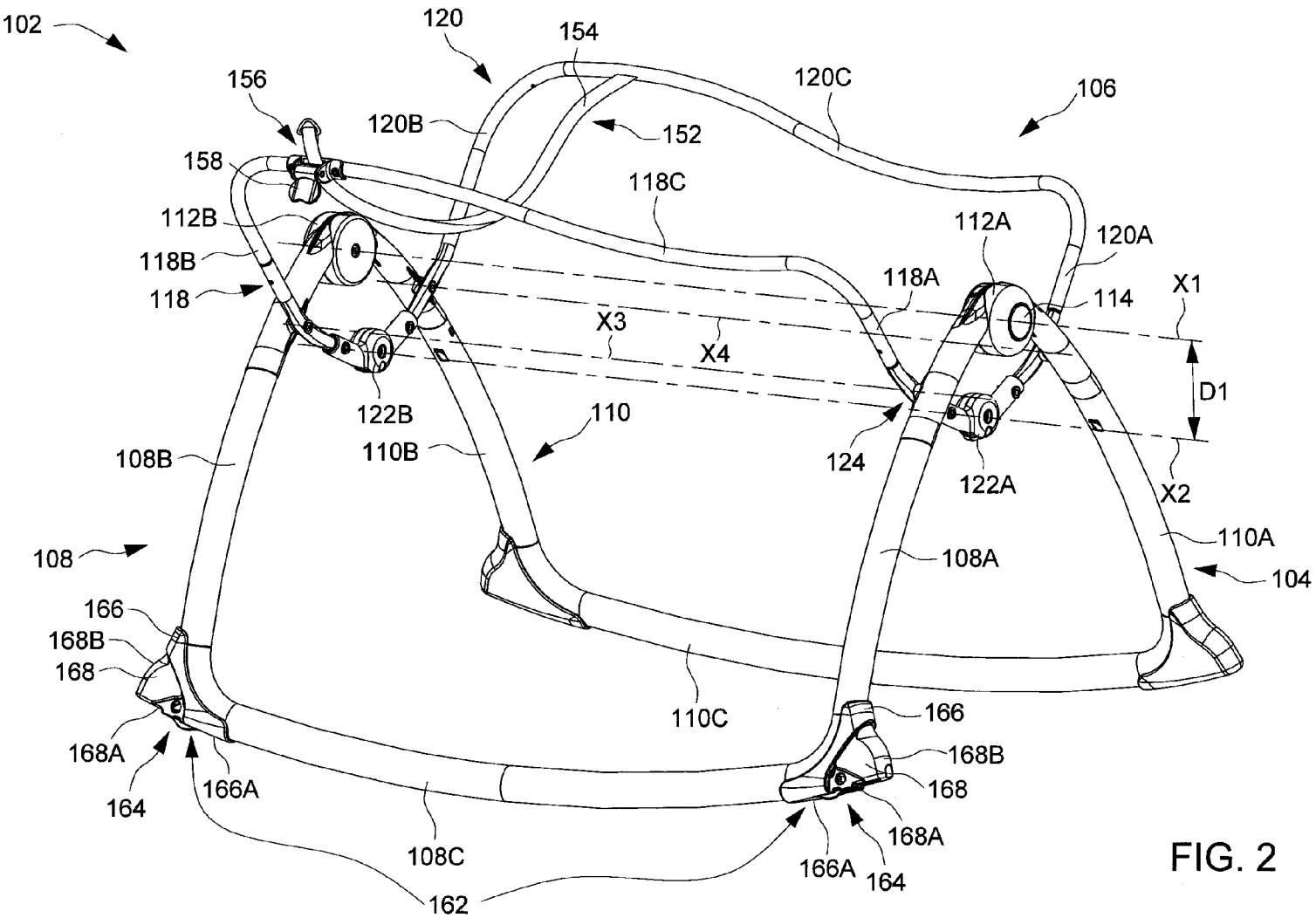
FIG. 2 is a schematic view illustrating a frame structure of the infant supporting apparatus.

FIG. 2 is a schematic view illustrating the frame structure 102. The base frame 104 of the frame structure 102 can include two leg frame portions 108 and 110 that are pivotally connected with each other about a pivot axis X1 extending along a horizontal direction. The leg frame portion 108 can be formed as a unitary tubular assembly of a U-like shape including two spaced-apart leg segments 108A and 108B, and a foot portion 108C of a curved shape extending along the pivot axis X1 between the two leg segments 108A and 108B. The foot portion 108C can be connected with the two leg segments 108A and 108B adjacent to the lower ends thereof. In a deployed state, the leg segments 108A and 108B can rise upward in a same direction toward the pivot axis X1.

Likewise, the leg frame portion 110 can be formed as a unitary tubular assembly of a U-like shape including two spaced-apart leg segments 110A and 110B, and a foot portion 110C of a curved shape extending along the pivot axis X1 between the two leg segments 110A and 110B. The foot portion 110C can be connected with the two leg segments 110A and 110B adjacent to the lower ends thereof. In a deployed state, the leg segments 110A and 110B can likewise rise upward in a same direction toward the pivot axis X1.

The two upper ends of the leg segments 108A and 110A can be pivotally connected with each other via a pivot structure 112A, and the two upper ends of the leg segments 108B and 110B can be pivotally connected with each other via a pivot structure 112B. The two pivot structures 112A and 112B can have the same pivot axis X1, and respectively form two apexes of the base frame 104. Accordingly, the two leg frame portions 108 and 110 can be operable to rotate about the pivot axis X1 toward each other when the frame structure 102 is collapsed, and away from each other when the frame structure 102 is deployed for use. In one embodiment, at least one of the two pivot structures 112A and 112B (e.g., the pivot structure 112A) may also include a latch mechanism that may be operable to lock the two leg frame portions 108 and 110 in the deployed state. The latch mechanism may be unlocked by pressing a release button 114 provided on an outer side of the pivot structure 112A.

Figure 2A:
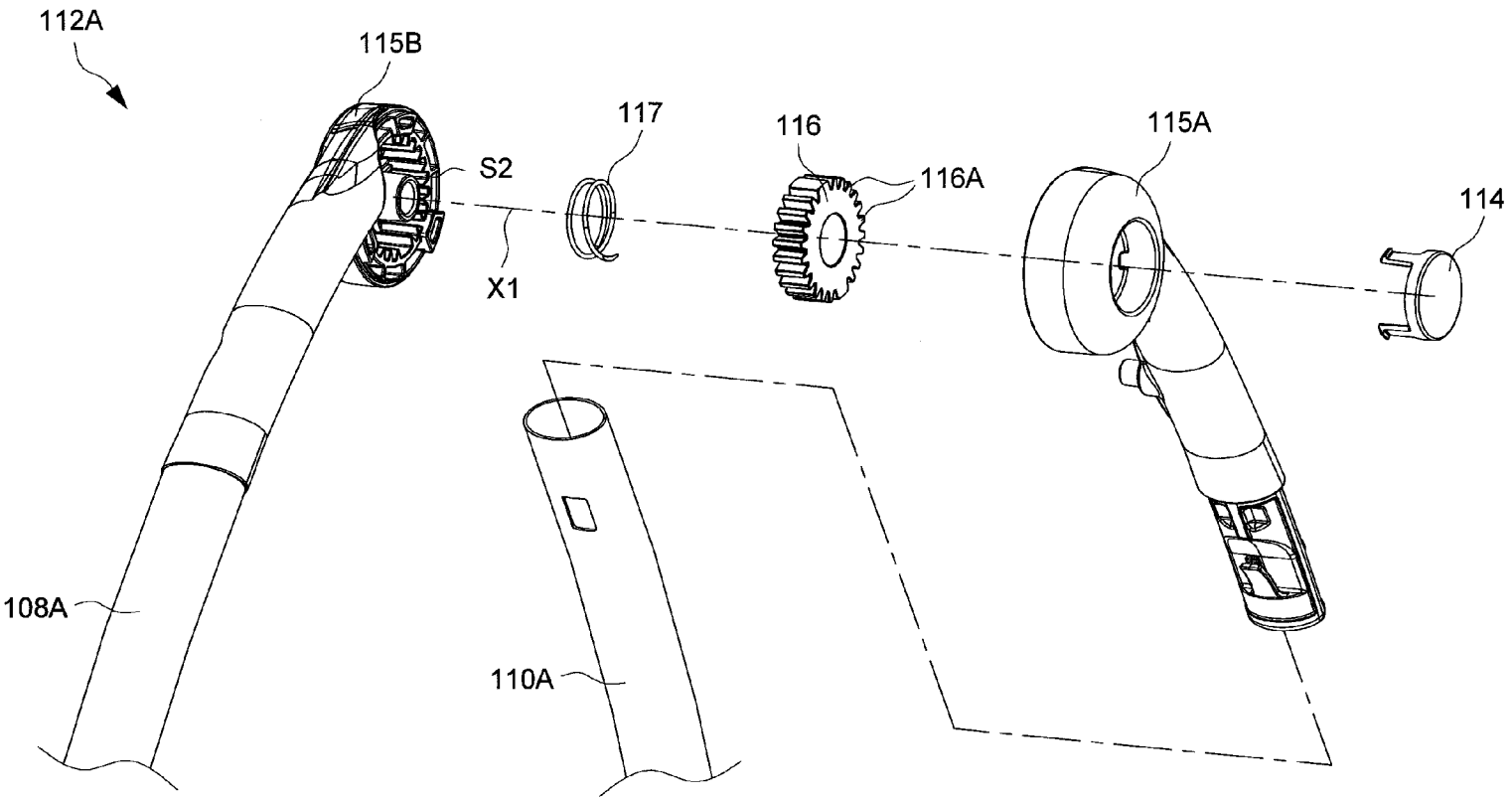
FIGS. 2A and 2B are exploded views illustrating the construction of a latch mechanism provided in a pivot structure of the frame structure.
Figure 2B:
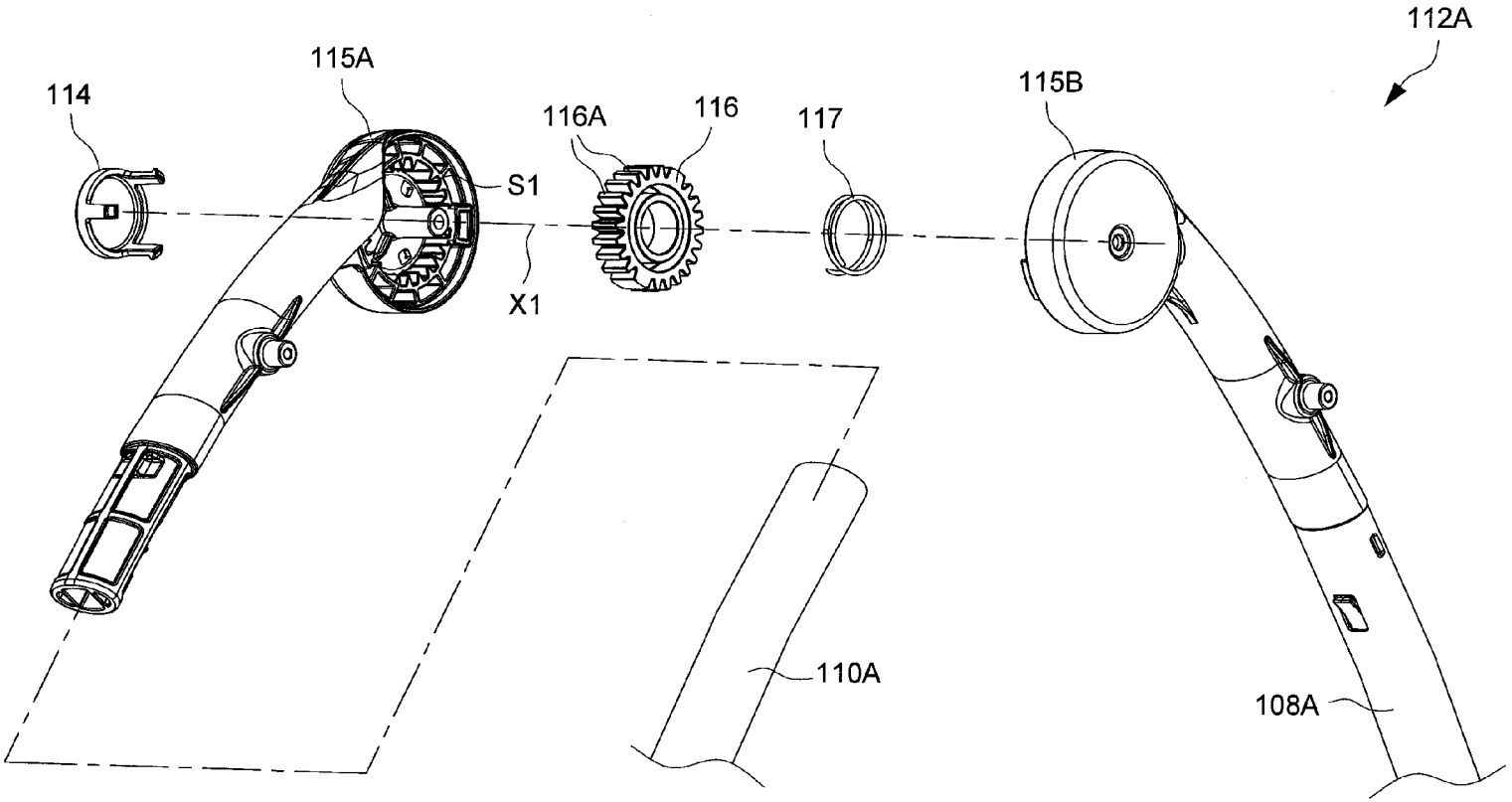

FIGS. 2A and 2B are exploded views illustrating an embodiment of the latch mechanism provided in the pivot structure 112A. The pivot structure 112A can include two coupling shells 115A and 115B that are respectively affixed with the leg segments 110A and 108A, a latch 116 assembled in a cavity defined between the two coupling shells 115A and 115B, and a spring 117 disposed between the latch 116 and an inner sidewall of the coupling shell 115B. The two coupling shells 115A and 115B can be pivotally connected with each other about the pivot axis X1, and can have inner surfaces respectively provided with a plurality of grooves S1 and S2. The latch 116 can be assembled for displacement along the pivot axis X1, and can have an outer peripheral edge provided with a plurality of teeth 116A adapted to engage with the grooves S1 and S2. The spring 117 can urge the latch 116 to a position where it can engage with the grooves S1 and S2 of the two coupling shells 115A and 115B so as to lock the two leg frame portions 108 and 110 in the deployed state. The release button 114 can be assembled with the coupling shell 115A at a side of the latch 116 that is opposite to that of the spring 117. The release button 114 can be depressed so as to cause the latch 116 to move along the pivot axis X1 toward the coupling shell 115B and disengage from the grooves S1 of the coupling shell 115A, thereby unlocking the pivot structure 112A for folding the leg frame portions 108 and 110.

Referring again to FIG. 2, the support frame 106 can be pivotally assembled with upper portions of the two leg frame portions 108 and 110, and include the assembly of two support frame portions 118 and 120. The two support frame portions 118 and 120 can be pivotally connected with each other about a pivot axis X2 that is substantially parallel to and located vertically below the pivot axis X1.

More specifically, the support frame portion 118 can be formed as a unitary tubular assembly including two spaced-apart support segments 118A and 118B, and a lateral segment 118C extending along the pivot axis X2 between the two support segments 118A and 118B. The lateral segment 118C can be connected with the two side segments 118A and 118B adjacent to the upper ends thereof. The two support segments 118A and 118B can bend from the lateral segment 118C and extend in a same direction toward the pivot axis X2.

Likewise, the support frame portion 120 can be formed as a unitary tubular assembly including two spaced-apart support segments 120A and 120B, and a lateral segment 120C extending along the pivot axis X2 between the two support segments 120A and 120B. The lateral segment 120C can be connected with the two side segments 120A and 120B adjacent to the upper ends thereof. The two support segments 120A and 120B can bend from the lateral segment 120C and extend in a same direction toward the pivot axis X2.

The two lower ends of the support segments 118A and 120A can be pivotally connected with each other via a pivot structure 122A, and the two lower ends of the support segments 118B and 120B can be pivotally connected with each other via a pivot structures 122B. The two pivot structures 122A and 122B can have the same pivot axis X2. The pivot axis X2 can be vertically aligned with the pivot axis X1, and can be located under the pivot axis X1. The support segments 118A and 120A once assembled together can form a V-like shape and respectively converge from the lateral segments 118C and 120C to the pivot structure 122A. The support segments 118B and 120B once assembled together can likewise form a V-like shape and respectively converge from the lateral segments 118C and 120C to the pivot structure 122B.

In addition, the support segments 118A and 118B of the support frame portion 118 can be respectively connected pivotally with the leg segments 108A and 108B of the leg frame portion 108 about a pivot axis X3, and the support segments 120A and 120B of the support frame portion 120 can be respectively connected pivotally with the leg segments 110A and 110B of the leg frame portion 110 about a pivot axis X4. The two locations where the support segments 118A and 120A are respectively connected with the leg segments 108A and 110A can be symmetrical relative to a vertical axis intersecting the pivot axes X1 and X2, and lower than the pivot axis X1. Likewise, the two locations where the support segments 118B and 120B are respectively connected with the leg segments 108B and 110B can be symmetrical relative to the vertical axis intersecting the pivot axes X1 and X2, and lower than the pivot axis X1.

In some embodiments, the pivot connections implemented between the support segments 118A and 118B of the support frame portion 118 and the leg segments 108A and 108B of the leg frame portion 108 can use conventional rivet assemblies. In other embodiments, concealed type rivet assemblies may be implemented for the pivot connections between the support segments 118A and 118B of the support frame portion 118 and the leg segments 108A and 108B of the leg frame portion 108.

Figure 3:
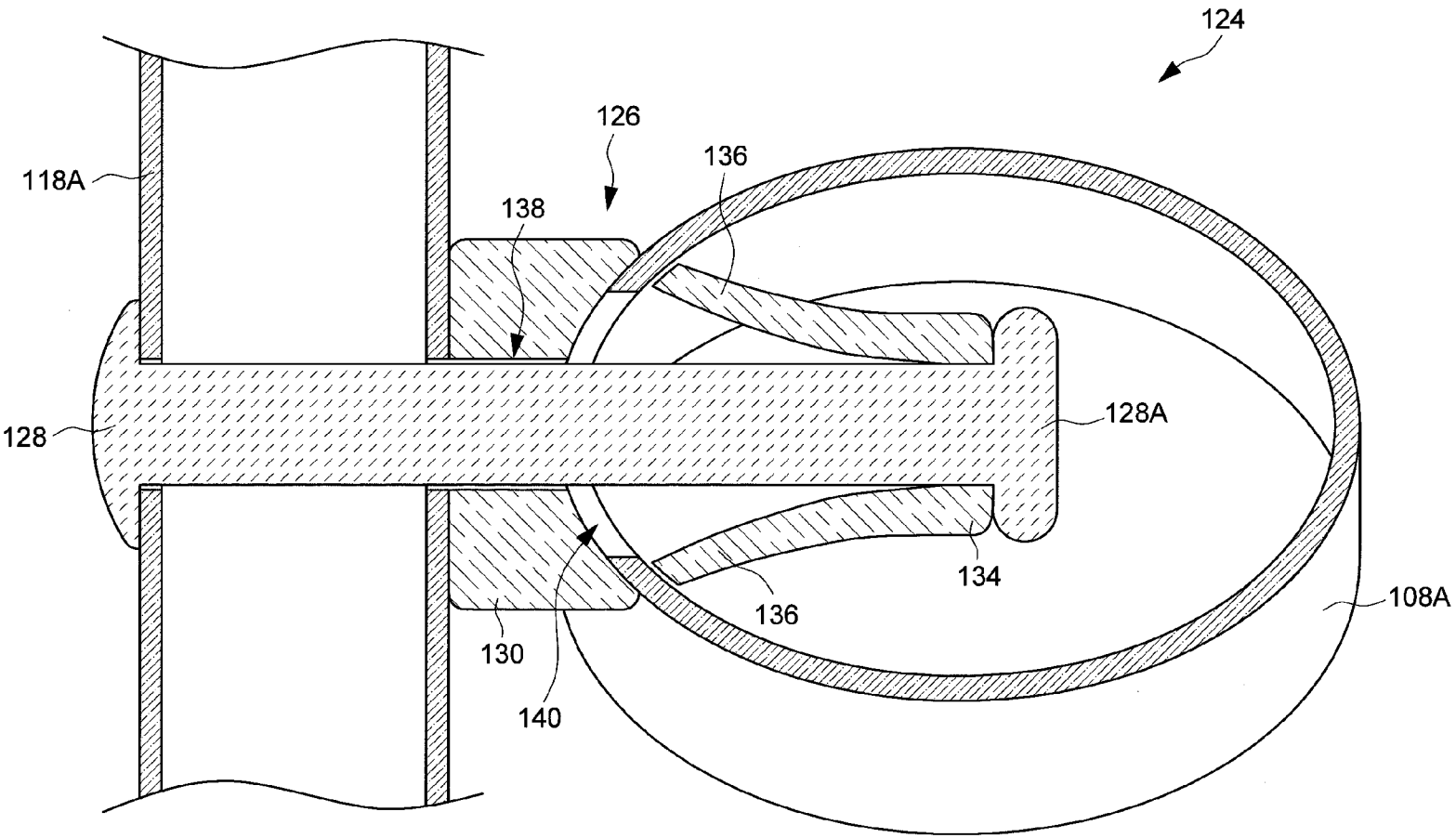
FIG. 3 is a cross-sectional view illustrating an example of pivot connection implemented in the frame structure of the infant supporting apparatus.

In conjunction with FIG. 2, FIG. 3 is a cross-sectional view illustrating more detail of a concealed type rivet assembly implemented as a pivot connection 124 between one support segment 118A of the support frame portion 118 and one leg segment 108A of the leg frame portion 108. The pivot connection 124 can include a coupling part 126 and a rivet 128. The coupling part 126 can be affixed with the leg segment 108A. The rivet 128 can be assembled with the support segment 118A, and can engage through the coupling part 126 to pivotally connect the support segment 118A with the leg segment 108A.

Figure 4:
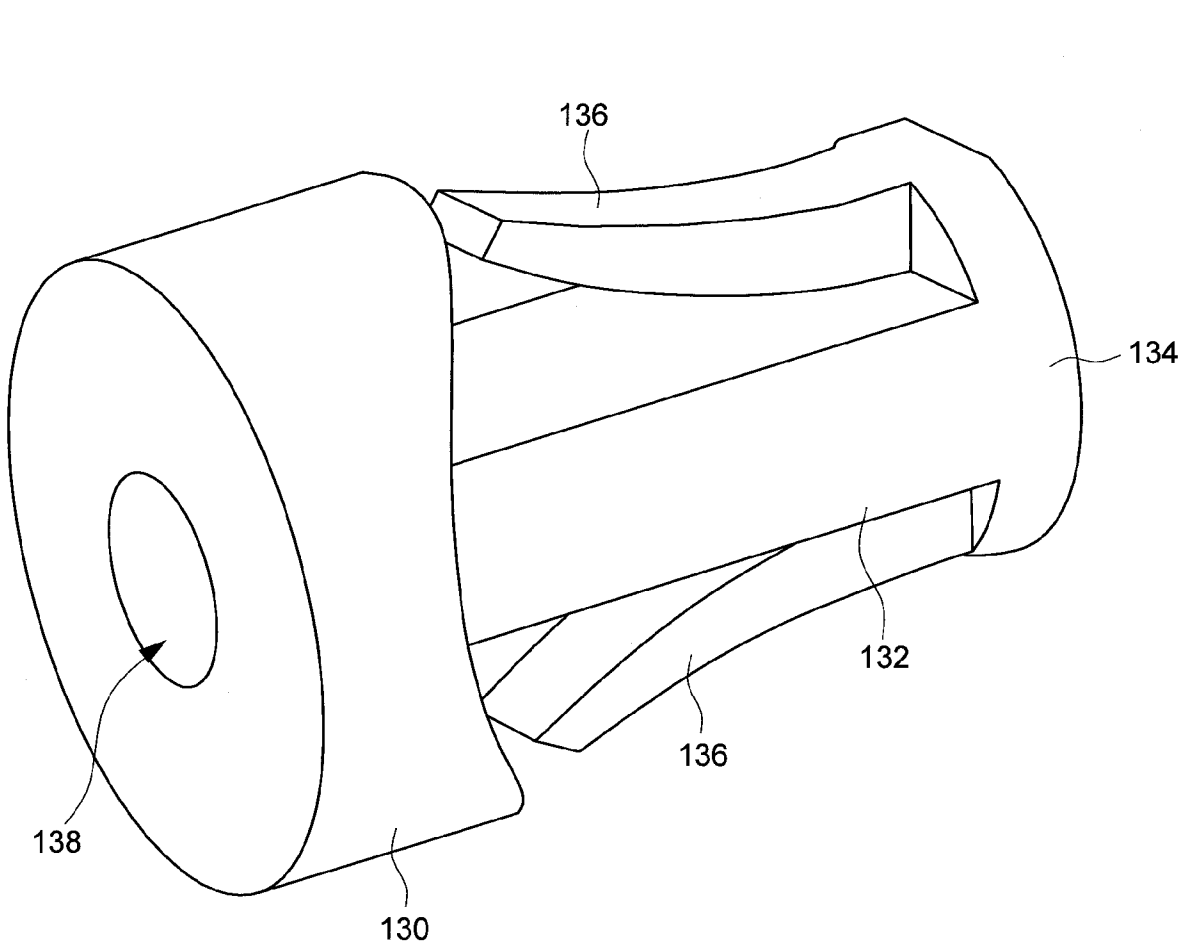
FIG. 4 is a perspective view of a coupling part used in the pivot connection shown in FIG. 3.

In conjunction with FIG. 3, FIG. 4 is a perspective view illustrating an embodiment of the coupling part 126. The coupling part 126 can be formed integrally as a molded plastic part including a base 130, and a column 132 projecting from the base 130. A distal end of the column 132 can form an annular flange 134 from which a plurality of molded barbs 136 project toward the base 130. The coupling part 126 can have a hole 138 that extends through the base 130 and the column 132.

For mounting the coupling part 126 with the leg segment 108A, the column 132 can be inserted through an opening 140 of the leg segment 108A into its interior. As the column 132 travels through the opening 140, the rim of the opening 140 can press the barbs 136 toward the column 132. Once the column 132 is fully inserted inside the leg segment 108A, the base 130 can lie adjacent to an outer surface of the leg segment 108A, and the barbs 136 can deflect outward and abut against an inner surface of the leg segment 108A around the opening 140 to prevent disassembly of the coupling part 126. The rivet 128 assembled with the support segment 118A then can be inserted from the side of the base 130 through the hole 138, until a head 128A of the rivet 128 travels past the distal end of the hole 138 and engages with the flange 134 inside the leg segment 108A. The leg segment 108A and the support segment 118A can be thereby pivotally assembled with each other. It is noted that the same pivot connection 124 can be applied to pivotally connect each of the leg segments 108A and 108B with the corresponding support segments 118A and 118B. The pivot connection 124 is realized only from the inner side of the frame structure 102 (i.e., the side facing the central region of the base frame 104 where is placed the resting support 103), and cannot be visible from an outer sidewall of the leg segment 108A facing the outside of the infant supporting apparatus 100. Accordingly, the outer appearance of the frame structure 102 can be improved.

Referring again to FIG. 2, the pivot axes X3 and X4 about which the support frame portions 118 and 120 respectively connect pivotally with the leg frame portions 108 and 110 can be symmetrical to each other relative to a vertical axis intersecting the pivot axes X1 and X2, and can be located at a same height that is above the pivot axis X2 and below the pivot axis X1. Moreover, all of the pivot axes X1-X4 can be substantially parallel to one another. With the symmetrical arrangement of the pivot axes X1-X4, the base frame 104 and the support frame 106 can rotate concurrently to collapse and deploy the frame structure 102.

Referring to FIGS. 1 and 2, the resting support 103 can include a fabric, cushion and like soft material for comfortable contact with a child. In some embodiments, the resting support 103 may also include a rigid or resilient board (not shown) to provide better support for the child. As shown in FIG. 1, the resting support 103 can include left and right sidewall portions 142 and 144, and a bottom portion 146 between the sidewall portions 142 and 144. The sidewall portions 142 and 144 can be respectively assembled with the lateral segments 118C and 120C of the support frame portions 118 and 120, so that the bottom portion 146 can be suspended from the support frame 106.

The bottom portion 146 can have a torso portion 148 adapted to support the back or trunk of the child, and a foot portion 150 adapted to support the leg and/or feet of the child. When a child is placed on the bottom portion 146, the head of the child is located in a head resting area close to the support segments 118B and 120B, and the foot of the child can be disposed adjacent to the foot portion 150 near the support segments 118A and 120A.

In one embodiment, the resting support 103 can also include a recline adjustment mechanism 152 operable to adjust an angle of inclination of the torso portion 148 relative to the lateral segments 118C and 120C of the support frame portions 118 and 120. As shown in FIGS. 1 and 2, the recline adjustment mechanism 152 can include a strap 154 and a lock device 156. The strap 154 can be routed transversally through the torso portion 148 from the left to the right side thereof, and can be respectively connected with the lateral segments 118C and 120C of the support frame 106. More specifically, the strap 154 can have an end affixed with the lateral segment (e.g., the lateral segment 120C) of either of the support frame portions 118 and 120, and an opposite end portion assembled with the lock device 156 on the lateral segment (e.g., the lateral segment 118C) of the other one of the support frame portions 118 and 120.

The lock device 156 can be affixed with the lateral segment 118C. In one embodiment, the lock device 156 can be constructed as a clamping device operable to clamp and release the strap 154. The lock device 156 can have a release tab 158 that can be actuated by a caregiver to unlock the lock device 156. When the lock device 156 is in a locked state, travel of the strap 154 through the lock device 156 is blocked so as to fix a length of the strap 154 joining the two lateral segments 118C and 120C. When the lock device 156 is unlocked, the strap 154 can be pulled to slide through the lock device 156 so as to adjust the length of the strap 154 joining the two lateral segments 118C and 120C: an increase of the length of the strap 154 joining the two lateral segments 118C and 120C can result in lowering the torso portion 148 relative to the lateral segments 118C and 120C to a recline position, and a decrease of the length of the strap 154 joining the two lateral segments 118C and 120C can result in rising the torso portion 148 relative to the lateral segments 118C and 120C to an upright position. The position of the lock device 156 can allow easy access and operation for adjusting the inclination of the torso portion 148 according to the needs.

Referring again to FIGS. 1 and 2, during use, the infant supporting apparatus 100 can be unfolded to a deployed state, and the foot portions 108C and 110C of the frame structure 102 can rest on a ground surface. Owing to the curved shape of the foot portions 108C and 110C, the infant supporting apparatus 100 can perform a rocking motion on the ground surface. In the deployed state, the pivot axes X1 and X2 can be separated from each other by a first distance D1. The leg segments 108A and 110A can respectively converge upward in a symmetrical manner like a reverse V-shape from the foot portions 108C and 110C to the pivot structure 112A, and the leg segments 108B and 110B can likewise converge upward in a symmetrical manner from the foot portions 108C and 110C to the pivot structure 112B. Moreover, the support segments 118A and 120A can respectively converge downward in a symmetrical manner like a V-shape from the lateral segments 118C and 120C to the pivot structure 122A, and the support segments 118B and 120B can likewise converge downward in a symmetrical manner from the lateral segments 118C and 120C to the pivot structure 122B. Because the support frame 106 is assembled with the base frame 104 at four connection points below the apexes of the base frame 104 formed by the two pivot structures 112A and 112B, the weight load can be distributed directly to the four leg segments 108A, 108B, 110A and 110B, which can provide a stronger design.

Figure 5:
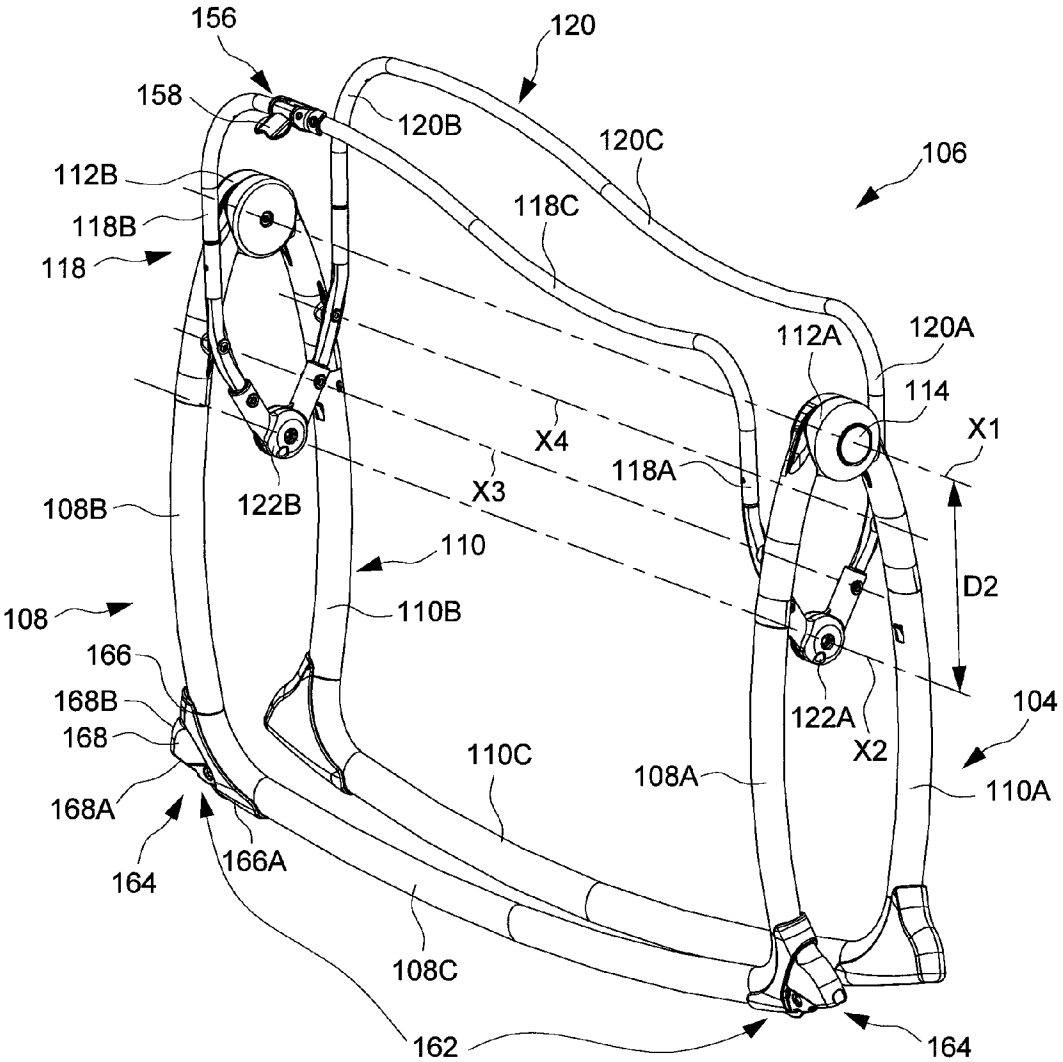
FIG. 5 is a schematic view illustrating the frame structure in a collapsed state.
Figure 6:
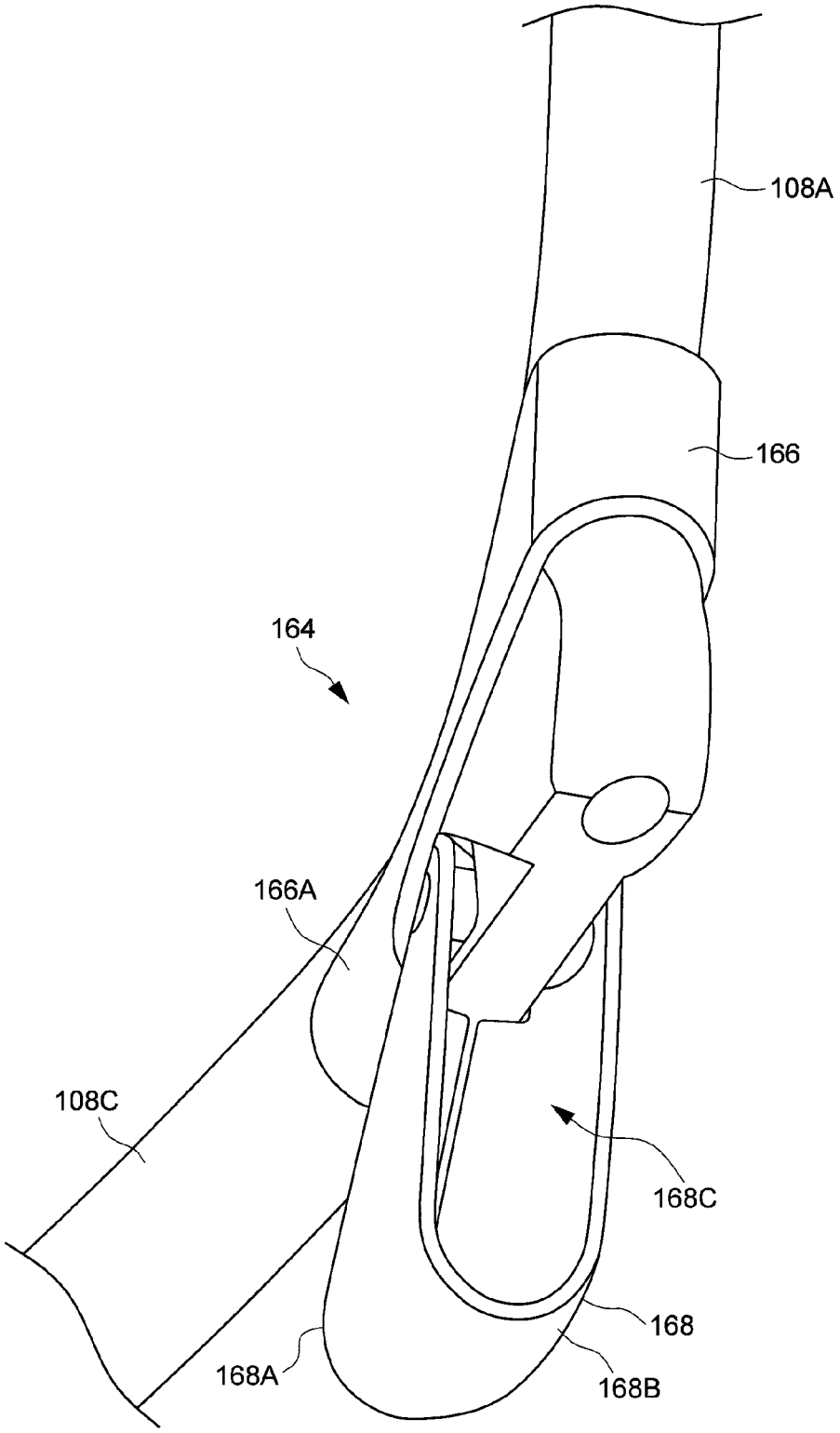
FIG. 6 is a schematic view illustrating one embodiment of a stabilizing structure used in the infant supporting apparatus.
Figure 7:
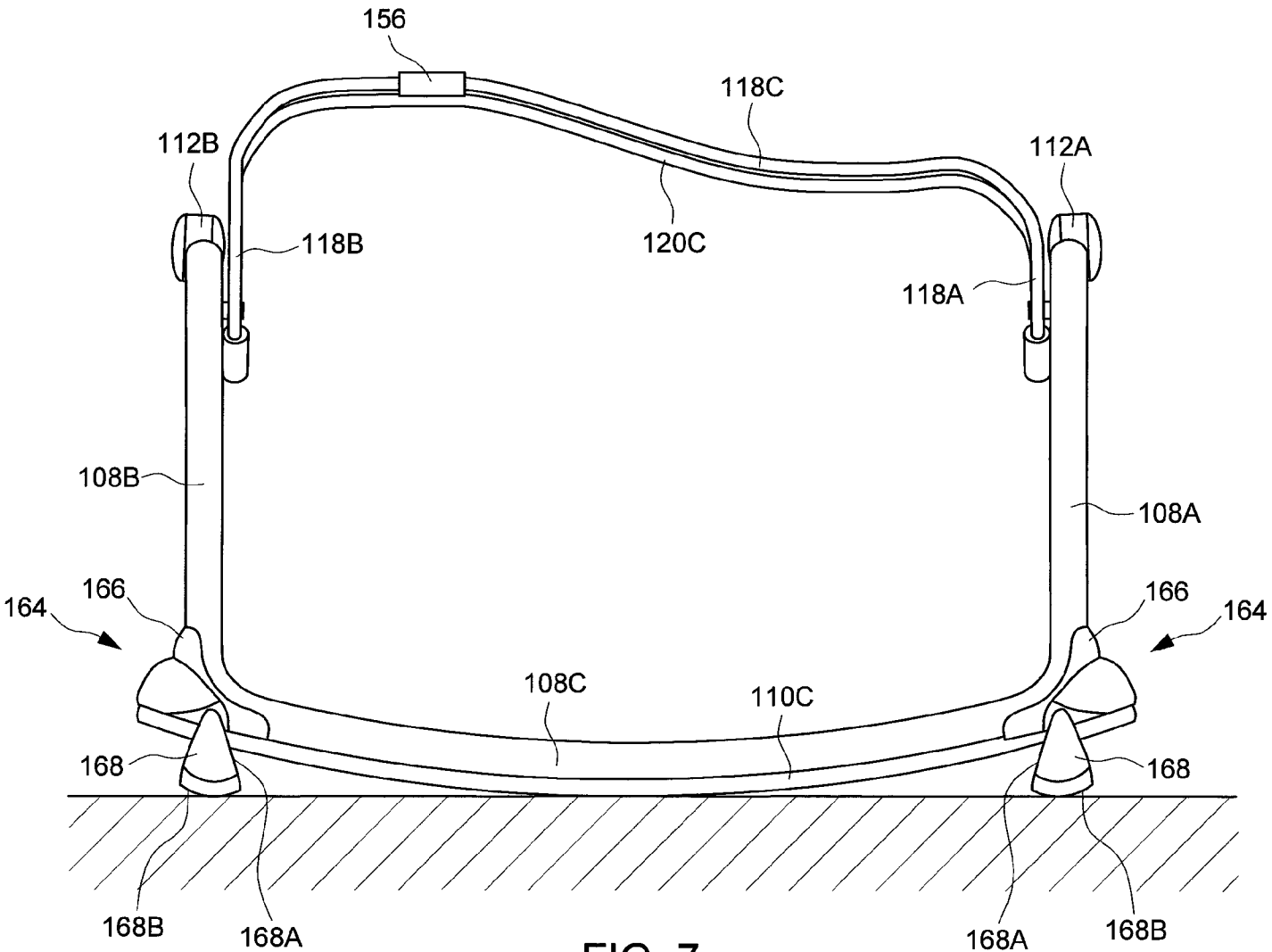
FIGS. 7 and 8 are schematic views illustrating one exemplary arrangement of the stabilizing structure.
Figure 8:
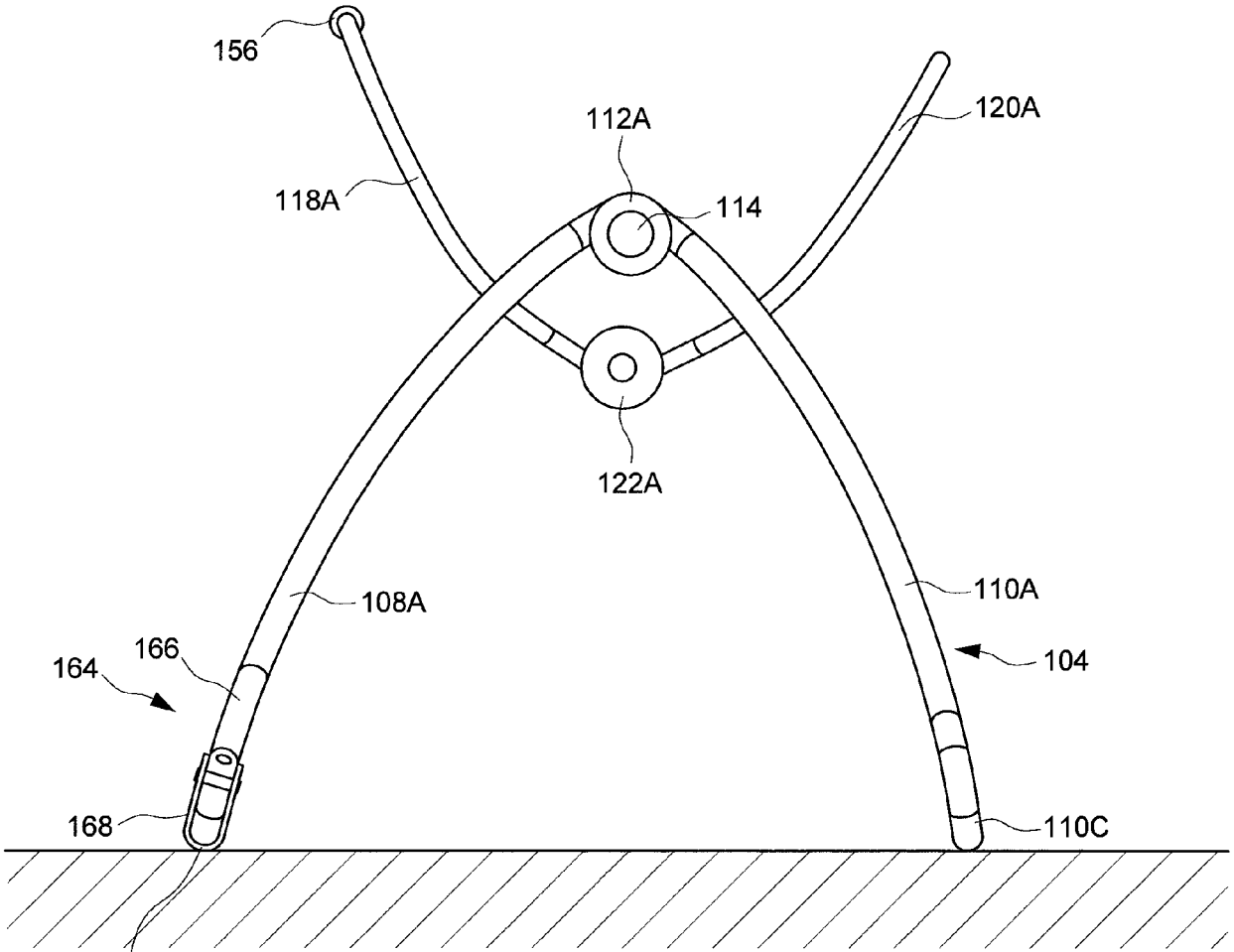

When the infant supporting apparatus 100 is unused, the frame structure 102 can be folded to a collapsed state as shown in FIG. 5. In particular, the leg frame portion 108 can fold onto the leg frame portion 110 about the pivot axis X1, the support frame portion 118 can fold onto the other support frame portion 120 about the pivot axis X2, and the pivot axis X2 can travel away from the pivot axis X1. Once the frame structure 102 is fully collapsed, the pivot axes X1 and X2 can be separated from each other by a second distance D2 that is greater than the first distance D1, and the infant supporting apparatus 100 can have a compact size that facilitates its storage and transport.

In conjunction with FIG. 2, FIGS. 6-8 are schematic views illustrating an embodiment of the stabilizing structure 162 assembled with the leg frame portions 108 and 110. The stabilizing structure 162 can include a plurality of pad assemblies 164 respectively mounted at different lower corners of the base frame 104. Each of the pad assemblies 164 can have a same construction including a base 166, and an adjustable foot 168 pivotally connected with the base 166. The base 166 can be affixed with a lower corner region of the leg frame portion 108 or 110, and can have a lower surface 166A that can generally match with the profile of the foot portions 108C or 110C.

The adjustable foot 168 can have a first surface 168A and a second surface 168B extending at an angle relative to each other, and an inner cavity 168C. The adjustable foot 168 can be snapped over the base 166, so that the base 166 is partially received in the inner cavity 168C and the first surface 168A smoothly prolongs the lower surface 166A of the base 166. In this configuration, the pad assembly 164 does not extend below the lowest point of the leg frame portions 108 and 110.

When the infant supporting apparatus 100 has to be kept stationary, the stabilizing structure 162 can be deployed by rotating downward the adjustable foot 168 of each pad assembly 164 so that the second surface 168B can lie below the lowest point of the leg frame portions 108 and 110 and rest against the ground surface. The pad assemblies 164 can thereby provide multiple stabilizing contact points against the ground surface that can block the rocking motion and keep the infant supporting apparatus 100 stationary. A stationary configuration of the infant supporting apparatus 100 may be needed, e.g., for feeding, nap time, or the like.

Multiple arrangements may be possible for the pad assemblies 164. In the embodiment shown in FIGS. 1, 7 and 8, two pad assemblies 164 can be respectively mounted with the leg frame portion 108: one pad assembly 164 is mounted adjacent to the corner junction between the foot portion 108C and the leg segment 108A, and another pad assembly 164 is mounted adjacent to the corner junction between the foot portion 108C and the leg segment 108B. When this configuration of the stabilizing structure 162 is deployed, the infant supporting apparatus 100 can be held in a position where one of the left or right sides of the frame structure 102 is pushed upward.

Figure 9:
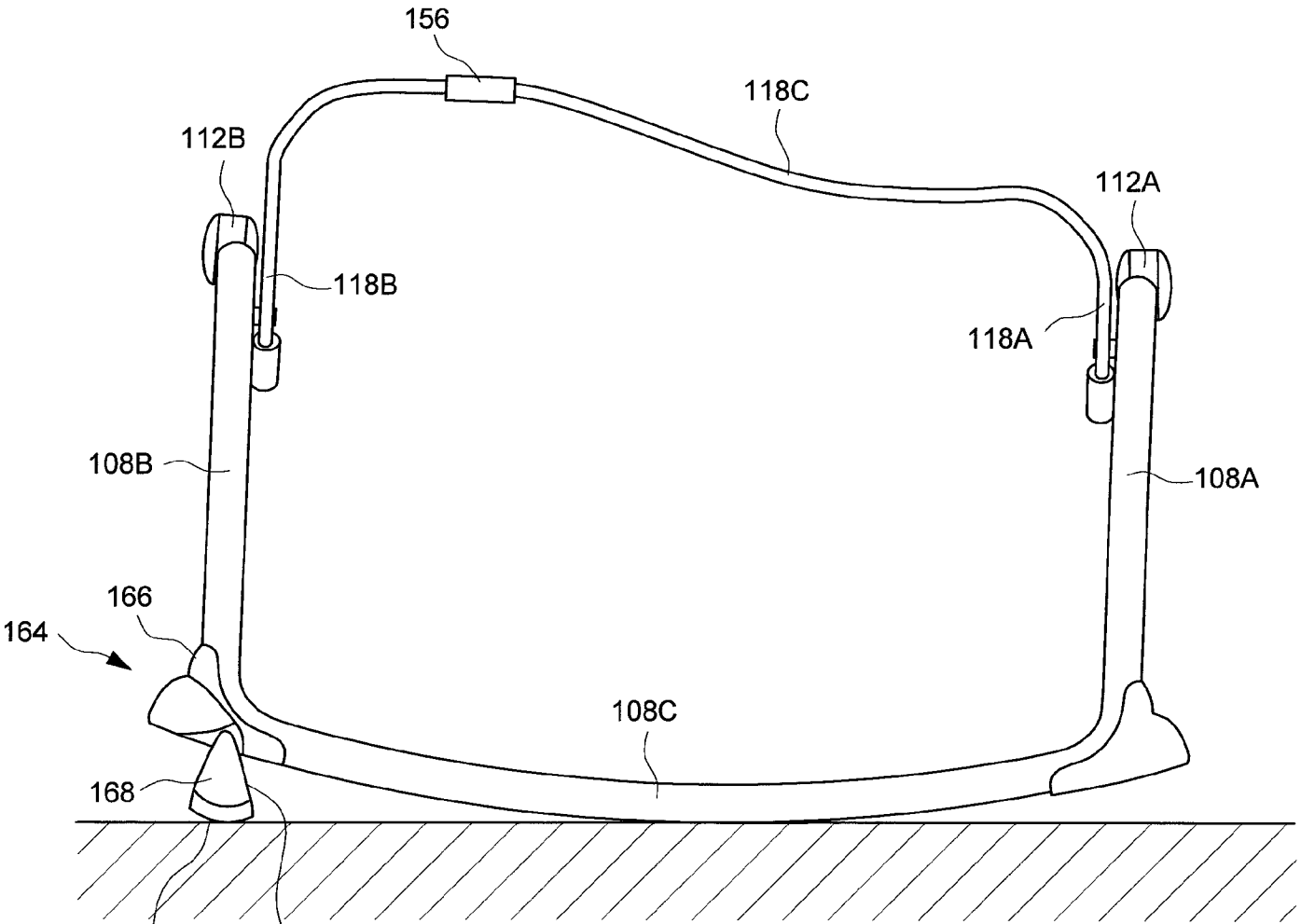
FIG. 9 is a schematic view illustrating another exemplary arrangement of the stabilizing structure.

FIG. 9 is a schematic view illustrating another embodiment in which two pad assemblies 164 can be respectively provided below the head resting area: one pad assembly 164 is mounted adjacent to the corner junction between the foot portion 108C and the leg segment 108B, and another pad assembly 164 is mounted adjacent to the corner junction between the foot portion 110C and the leg segment 110B. When this configuration of the stabilizing structure 162 is deployed, the infant supporting apparatus 100 can be held in a more upright position where the head resting area is pushed upward.

In other embodiments (not shown), four pad assemblies 164 may be respectively provided at the four lower corner regions of the base frame 104. When this configuration of the stabilizing structure 162 is deployed, the infant supporting apparatus 100 can be held stationary in a position where the foot portions 108C and 110C do not contact with the ground surface.

Figure 10:
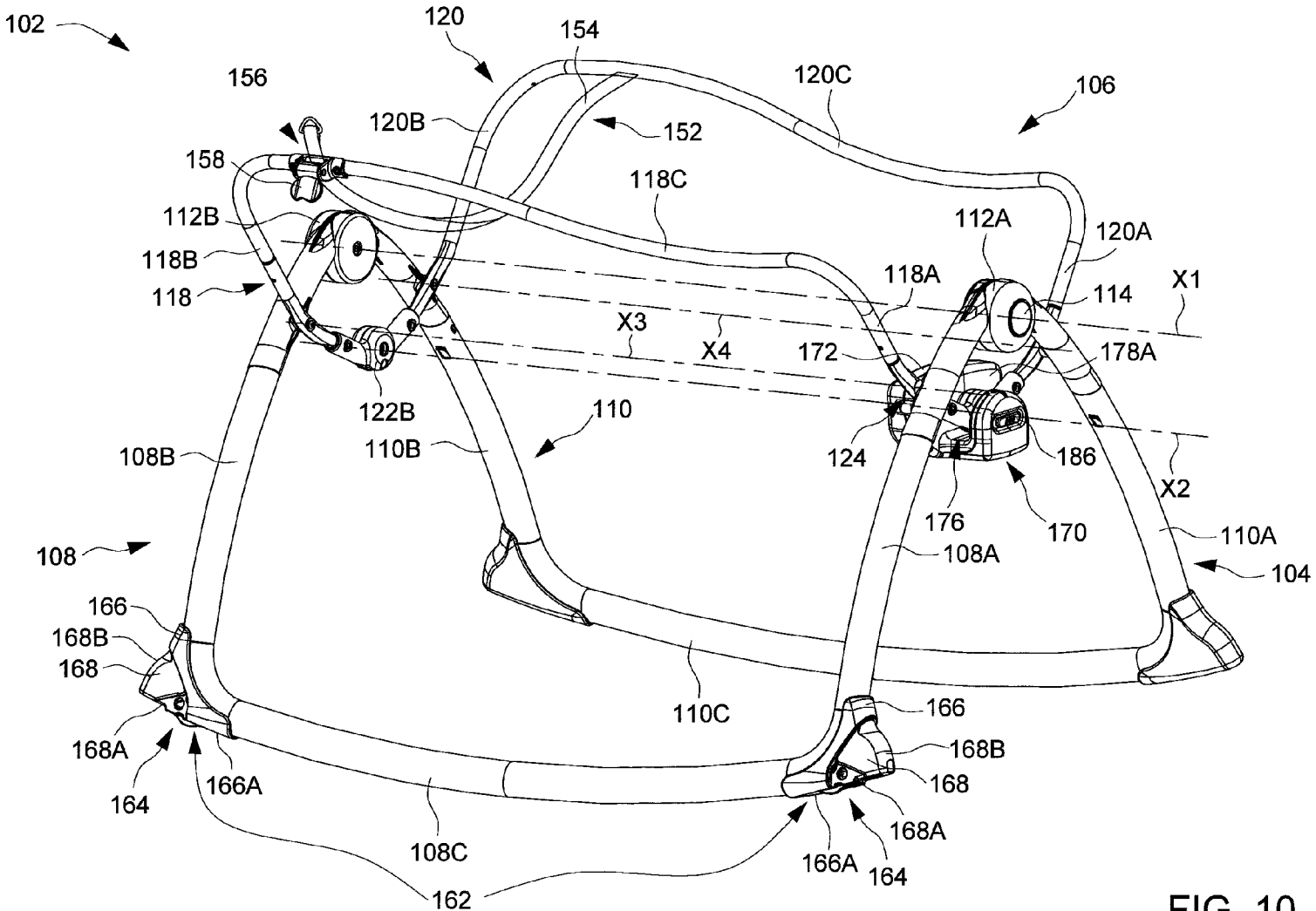
FIG. 10 is a schematic view illustrating another embodiment of the infant supporting apparatus provided with a vibrating unit.

FIG. 10 is a schematic view illustrating another embodiment in which the infant supporting apparatus 100 can be attached with a vibrating unit 170. The vibrating unit 170 can be operable to impart vibration to the infant supporting apparatus 100 for providing a soothing sensation to a child placed on the resting support 103. The vibrating unit 170 can be detachably fastened with one of the two pivot structures 122A and 122B that connect the two support frame portions 118 and 120 with each other, e.g., the pivot structure 122A.

Figure 11:
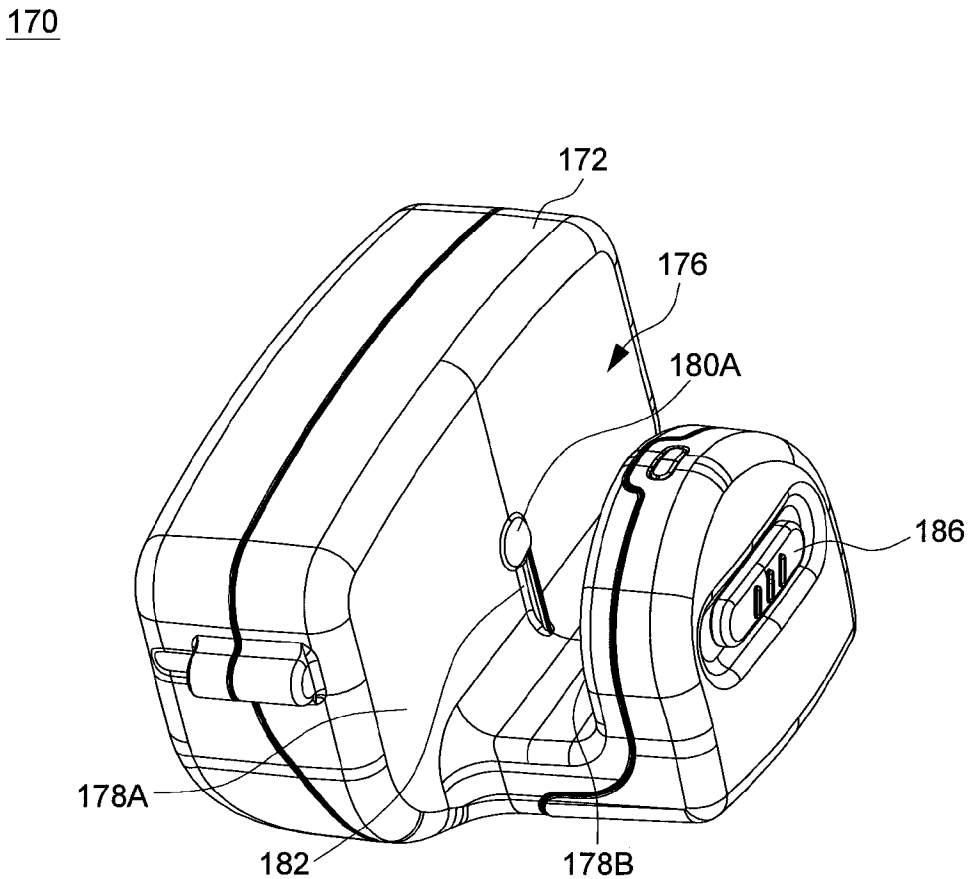
FIGS. 11 and 12 are perspective views illustrating the vibrating unit.
Figure 12:
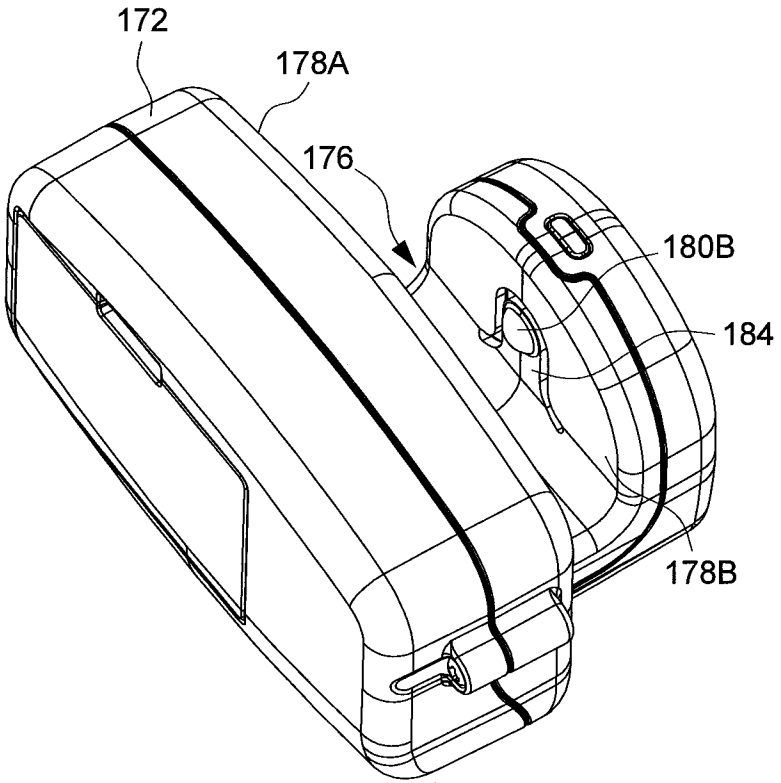

FIGS. 11 and 12 are perspective views illustrating the vibrating unit 170. The vibrating unit 170 can include an outer housing 172 that encloses various component parts (not shown), such as a motor, a rotor, an eccentric member, a battery, etc. The outer housing 172 can include a recess 176 defined between two opposite sidewalls 178A and 178B. The two sidewalls 178A and 178B can respectively include protruding knobs 180A and 180B that are aligned with each other. The knob 180A can be affixed with the sidewall 178A, and can be connected with an keying rib 182 having an elongated shape. The knob 180B can project from a detent 184 formed as resilient tab connected with the sidewall 178B. The vibrating unit 170 can also include a button 186 operable to switch on or off the vibrating unit 170.

Figure 13:
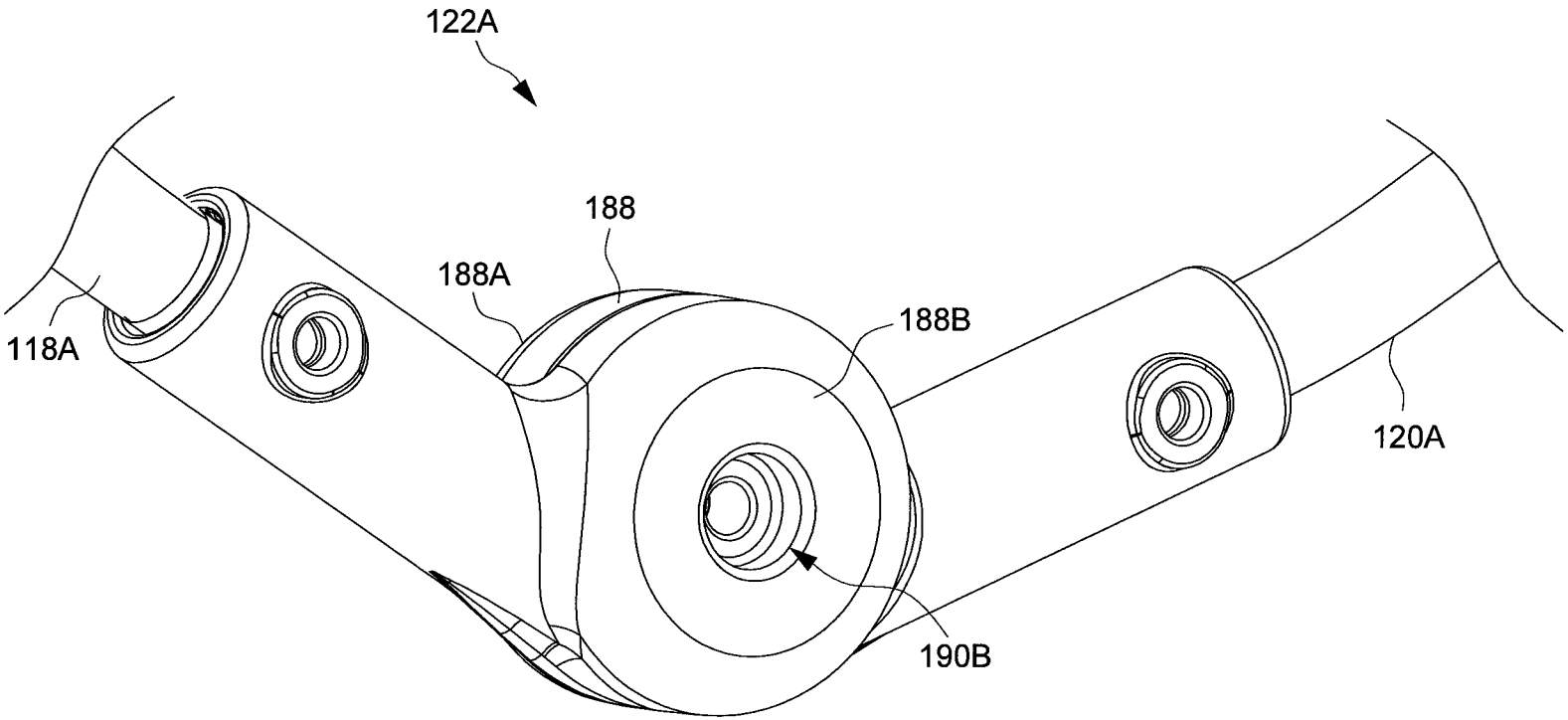
FIGS. 13 and 14 are perspective views illustrating two opposite sides of a pivot structure of the frame structure to which the vibrating unit can be attached.
Figure 14:
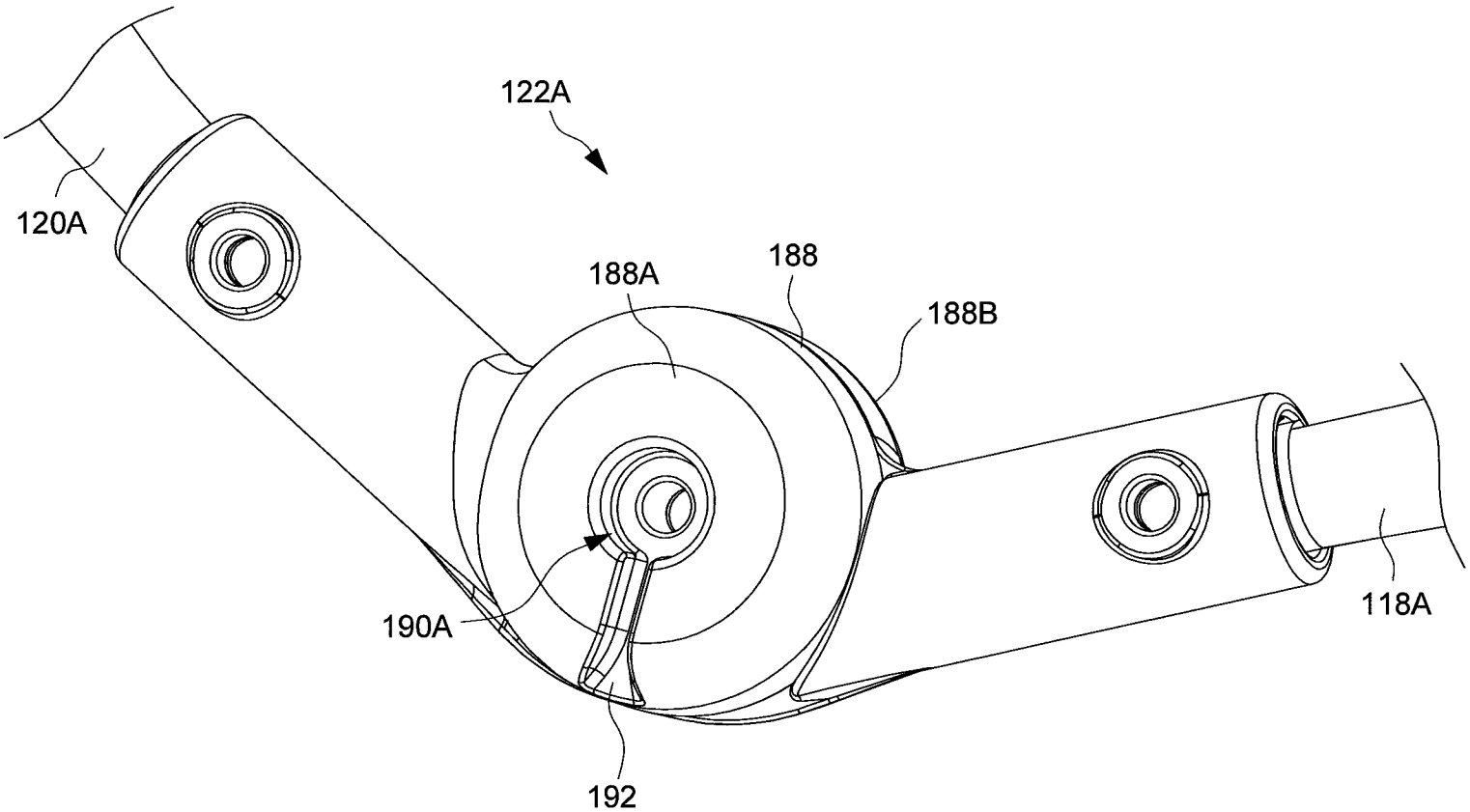

FIGS. 13 and 14 are perspective views illustrating two opposite sides of the pivot structure 122A. The pivot structure 122A can include an outer shell assembly 188 having two opposite sidewalls 188A and 188B respectively provided with two recesses 190A and 190B. The sidewall 188A can further include a groove 192 connected with the recess 190A.

For attaching the vibrating unit 170 with the pivot structure 122A, the outer shell assembly 188 can be inserted in the recess 176 of the outer housing 172, until the keying rib 182 mates with the groove 192 and the knobs 180A and 180B respectively engage with the recesses 190A and 190B. The engagement of the keying rib 182 with the groove 192 can block rotation of the vibrating unit 170. Once the vibrating unit 170 is powered on, vibration can be effectively transmitted from the pivot structure 122A through the two support frame portions 118 and 120 to the resting support 103. Vibration dispersion through the base frame 104 can be prevented owing to the firm engagement between the vibrating unit 170 and the pivot structure 122A.

When the vibrating unit 170 is not needed, the caregiver can apply a downward force on the vibrating unit 170, which forces the detent 184 to deflect for disengaging the knob 180B from the recess 190B. The vibrating unit 170 then can be removed from the pivot structure 122A.

The structures as described herein can include various advantages. With the symmetrical frame structure, the weight load can be transmitted from the support segments directly to the leg segments to which they are respectively assembled, which can provide a stronger design. Moreover, the infant supporting apparatus is easy to collapse and deploy, and has a better appearance.

In addition, the recline adjustment mechanism, the stabilizing structure and the vibrating unit may add functional features that can advantageously modify the configuration of the infant supporting apparatus according to the needs of the caregiver and provide comfort to the child. It will be understood that the frame structure as described herein may also be implemented without these functional features, or with any combination of one or more of these functional features.

Therefore, realizations of the infant supporting apparatus have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. An infant supporting apparatus comprising:

a base frame including a first and a second leg frame portion pivotally connected with each other about a first pivot axis, wherein the first leg frame portion includes two first leg segments and a first foot portion connected with and extending between the two first leg segments, the second leg frame portion includes two second leg segments and a second foot portion connected with and extending between the two second leg segments, the two first leg segments being respectively connected pivotally with the two second leg segments through two pivot structures that define the first pivot axis, the first and second foot portions extending along the first pivot axis and positionable on a ground surface to provide support for the infant supporting apparatus;

a support frame assembled with the base frame, wherein the support frame includes a first and a second support frame portion pivotally connected with each other about a second pivot axis spaced apart from the first pivot axis, the first and second pivot axes being vertically aligned with each other; and a resting support suspended from the first and second support frames for receiving the placement of a child;

wherein when the infant supporting apparatus stands on a ground surface in a deployed state, the second pivot axis is located below the first pivot axis, and the second pivot axis is at a position that is closer to the first pivot axis than the ground surface.

2. The infant supporting apparatus according to claim 1, wherein the first support frame portion includes two first support segments and a first lateral segment connected with and extending between the two first support segments, and the second support frame portion includes two second support segments and a second lateral segment connected with and extending between the two second support segments, the two first support segments being respectively connected pivotally with the two second support segments through two second pivot structures that define the second pivot axis.

3. The infant supporting apparatus according to claim 2, wherein the first and second leg segments respectively converge upward from the first and second foot portions to the first pivot axis, and the first and second support segments respectively converge downward to the second pivot axis.

4. The infant supporting apparatus according to claim 2, wherein the two first support segments are respectively connected with the two first leg segments at two locations that are lower than the first pivot axis, and the two second support segments are respectively connected with the two second leg segments at two other locations that are lower than the first pivot axis.

5. The infant supporting apparatus according to claim 2, wherein the first support segments are respectively connected pivotally with the first leg segments about a third pivot axis, and the second support segments are respectively connected pivotally with the second leg segments about a fourth pivot axis.

6. The infant supporting apparatus according to claim 5, wherein at least one of the first support segments is pivotally connected with one of the first leg segments via a pivot connection including:

a coupling part affixed with the first leg segment and having a column received in an interior of the first leg segment; and a rivet assembled with the first support segment, wherein the rivet has a head that engages with a flange of the column in the interior of the first leg segment.

7. The infant supporting apparatus according to claim 5, wherein the third and fourth pivot axes are located at a substantially similar height that is above the second pivot axis and below the first pivot axis.

8. The infant supporting apparatus according to claim 2, wherein the resting support is suspended between the first and second lateral segments, and the first and second support segments respectively converge downward from the first and second lateral segments to the second pivot axis.

9. The infant supporting apparatus according to claim 2, wherein the resting support is suspended between the first and second lateral segments, the resting support including a torso portion adapted to receive a trunk of a child, and a recline adjustment mechanism operable to adjust an angle of inclination of the torso portion.

10. The infant supporting apparatus according to claim 9, wherein the recline adjusting mechanism includes:

a lock device affixed with the first lateral segment; and a strap extending transversally relative to the torso portion, wherein the strap has an end affixed with the second lateral segment, and is assembled with the lock device on the first lateral segment.

11. The infant supporting apparatus according to claim 2, wherein the resting support is suspended between the first and second lateral segments, and the infant supporting apparatus further includes a detachable vibrating unit adapted to fasten with one of the second pivot structures.

12. The infant supporting apparatus according to claim 1, wherein the base frame further includes a stabilizing structure, the stabilizing structure including a plurality of pad assemblies respectively provided at a plurality of lower corner regions of the base frame, the pad assemblies being operable to provide multiple stabilizing contact points against a ground surface.

13. The infant supporting apparatus according to claim 1, wherein each of the first and second foot portions respectively has a curved shape capable of rocking on a ground surface.

14. The infant supporting apparatus according to claim 1, wherein one of the two pivot structures includes a latch operable to block rotation of the pivot structure and lock the infant supporting apparatus in a deployed state, and a release button operable to cause displacement of the latch for unlocking the pivot structure.

15. An infant supporting apparatus comprising:

a base frame including a first and a second leg segment pivotally connected with each other via a first pivot structure that defines a first pivot axis, wherein the first and second leg segments are further respectively connected to a first and a second foot portion;

a support frame including a first and a second support segment, and a first and a second lateral segment respectively connected with the first and second support segment, wherein the first and second support segments are respectively connected with the first and second leg segments at two locations below the first pivot axis, and the first and second support segments are pivotally connected with each other via a second pivot structure that defines a second pivot axis spaced apart from and vertically aligned with the first pivot axis; and a resting support suspended from the first and second lateral segments for receiving the placement of a child;

wherein when the infant supporting apparatus stands on a ground surface in a deployed state, the second pivot axis is located below the first pivot axis, and the second pivot axis is at a position that is closer to the first pivot axis than the ground surface.

16. The infant supporting apparatus according to claim 15, wherein the first leg segment and the first support segment are respectively symmetrical to the second leg segment and the second support segment relative to a vertical axis intersecting the first and second pivot axes.

17. The infant supporting apparatus according to claim 15, wherein the first and second leg segments converge upward from the foot portions to the first pivot structure, and the first and second support segments converge downward from the lateral segments to the second pivot structure.

18. The infant supporting apparatus according to claim 15, wherein the first support segment is pivotally connected with the first leg segment about a third pivot axis, and the second support segment is pivotally connected with the second leg segment about a fourth pivot axis.

19. The infant supporting apparatus according to claim 18, wherein the third and fourth pivot axes are located at a substantially similar height that is above the second pivot axis and below the first pivot axis.

20. The infant supporting apparatus according to claim 15, wherein the first support segment is pivotally connected with the first leg segment via a pivot connection including:

a coupling part affixed with the first leg segment and having a column received in an interior of the first leg segment; and a rivet assembled with the first support segment, wherein the rivet has a head that engages with a flange of the column in the interior of the first leg segment.

21. The infant supporting apparatus according to claim 15, wherein the resting support is suspended between the first and second lateral segments, the resting support including a torso portion adapted to receive a trunk of a child, and a recline adjustment mechanism operable to adjust an angle of inclination of the torso portion.

22. The infant supporting apparatus according to claim 21, wherein the recline adjusting mechanism includes:

a lock device affixed with the first lateral segment; and a strap extending transversally relative to the torso portion, wherein the strap has an end affixed with the second lateral segment, and is assembled with the lock device on the first lateral segment.

23. The infant supporting apparatus according to claim 15, wherein the resting support is suspended between the first and second lateral segments, and the infant supporting apparatus further includes a detachable vibrating unit adapted to fasten with the second pivot structure.

24. The infant supporting apparatus according to claim 15, wherein the base frame further includes a stabilizing structure, the stabilizing structure including a plurality of pad assemblies respectively provided at a plurality of lower corner regions of the base frame, the pad assemblies being operable to provide multiple stabilizing contact points against a ground surface.

25. The infant supporting apparatus according to claim 15, wherein each of the first and second foot portions respectively has a curved shape capable of rocking on a ground surface.

* * * * *